US010546550B2

(12) United States Patent
Sun et al.

(10) Patent No.: US 10,546,550 B2
(45) Date of Patent: Jan. 28, 2020

(54) METHOD AND DEVICE FOR DRIVING GOA CIRCUIT, TIME CONTROLLER, AND DISPLAY DEVICE

(71) Applicants: BOE TECHNOLOGY GROUP CO., LTD., Beijing (CN); BEIJING BOE DISPLAY TECHNOLOGY CO., LTD., Beijing (CN)

(72) Inventors: Zhihua Sun, Beijing (CN); Xu Zhang, Beijing (CN); Guohuo Su, Beijing (CN); Zhihao Zhang, Beijing (CN)

(73) Assignees: BOE TECHNOLOGY GROUP CO., LTD., Beijing (CN); BEIJING BOE DISPLAY TECHNOLOGY CO., LTD., Beijing (CN)

( * ) Notice: Subject to any disclaimer, the term of this patent is extended or adjusted under 35 U.S.C. 154(b) by 97 days.

(21) Appl. No.: 15/246,711

(22) Filed: Aug. 25, 2016

(65) Prior Publication Data

US 2017/0193948 A1 Jul. 6, 2017

(30) Foreign Application Priority Data

Jan. 4, 2016 (CN) ..... 2016 1 0004860

(51) Int. Cl.
*G09G 3/36* (2006.01)

(52) U.S. Cl.
CPC ..... *G09G 3/3677* (2013.01); *G09G 3/3688* (2013.01); *G09G 3/3648* (2013.01);
(Continued)

(58) Field of Classification Search
CPC .. G09G 3/3648; G09G 3/3614; G09G 3/2003; G09G 3/3233; G09G 3/3607;
(Continued)

(56) References Cited

U.S. PATENT DOCUMENTS 7,466,387 B2 * 12/2008 Kim ..... G02F 1/1345 345/77
2005/0001792 A1 * 1/2005 Watanabe ..... G09G 3/22 345/55
(Continued)

FOREIGN PATENT DOCUMENTS

CN 1573850 A 2/2005
CN 1979603 A * 6/2007 ..... G09G 3/006
(Continued)

OTHER PUBLICATIONS

English language translation of CN1979603A; Date: Jun. 13, 2007. Inventor: Hee Hwang Jong. Title: Flat display panel, picture quality controlling apparatus thereof and picture quality controlling method thereof (Year: 2007).*
(Continued)

*Primary Examiner* — Julie Anne Watko
(74) *Attorney, Agent, or Firm* — Brooks Kushman P.C.

(57) ABSTRACT

The present disclosure provides a method and a device for driving a GOA circuit, a time controller and a display device. The method includes steps of: determining a bright-dark period for striped patterns on a display panel; and compensating for data signals at rows where the striped patterns are located periodically in accordance with the bright-dark period.

18 Claims, 2 Drawing Sheets

(52) U.S. Cl.
CPC ..... *G09G 2310/067* (2013.01); *G09G 2320/0233* (2013.01)

(58) Field of Classification Search
CPC ..... G09G 3/003; G09G 3/3266; G09G 2320/0233; G09G 2320/0247; G09G 2320/0242; G09G 2320/0261; G09G 2320/0266; G09G 2320/0238; G09G 2320/043; G09G 2320/0209; G09G 2320/0626; G09G 2300/0426; G09G 2300/0452; G09G 2300/0819; G09G 2300/0842; G09G 2300/0861; G09G 2310/0251; G09G 2320/0223; G09G 2310/067; G09G 3/3688; G09G 3/3677; G09G 3/3666; G09G 3/3611; G09G 3/3674; G09G 3/3685; G09G 3/34; G09G 3/36; G09G 3/3225; G09G 3/22; G09G 3/20; G09G 3/00; G09G 3/006; G02F 1/1309; G02F 1/1306; G02F 1/1303; G02F 1/13; G02F 1/01; G02F 1/00
USPC ..... 324/760.01, 760.02
See application file for complete search history.

(56) References Cited

U.S. PATENT DOCUMENTS

2005/0012873 A1* 1/2005 Park ..... G02F 1/13454 349/43
2006/0072664 A1* 4/2006 Kwon ..... G09G 3/20 375/240.16
2007/0126758 A1* 6/2007 Hwang ..... G09G 3/006 345/690
2007/0159441 A1* 7/2007 Yang ..... G09G 3/3677 345/99
2008/0007496 A1* 1/2008 Kim ..... G09G 3/3216 345/80
2010/0020065 A1* 1/2010 Takasugi ..... G09G 3/3233 345/214
2011/0234930 A1* 9/2011 Nishida ..... G09G 3/3655 349/33
2013/0265347 A1* 10/2013 Bae ..... G09G 5/10 345/691
2014/0146025 A1* 5/2014 Shi ..... G09G 3/3648 345/204
2015/0015553 A1* 1/2015 Cho ..... G09G 3/3611 345/208
2015/0255014 A1* 9/2015 Lin ..... G11C 19/28 345/84
2015/0302817 A1* 10/2015 Sun ..... G09G 3/20 345/89
2016/0335972 A1* 11/2016 Lee ..... G09G 3/3677
2017/0124979 A1* 5/2017 Huang ..... G02F 1/13306
2017/0200412 A1* 7/2017 Gu ..... G09G 3/3233
2018/0033392 A1* 2/2018 Xie ..... G09G 5/003
2018/0336823 A1* 11/2018 Lin ..... G09G 3/3233

FOREIGN PATENT DOCUMENTS

CN 1979603 A 6/2007
CN 101046936 A 10/2007
CN 101398553 4/2009
CN 102629460 A 8/2012
JP 2003255884 A 9/2003

OTHER PUBLICATIONS

First Office Action for Chinese Application No. 201610004860.1, dated Jun. 2, 2017, 8 Pages.
Third Office Action for Chinese Application No. 201610004860.1, dated Mar. 12, 2018, 8 Pages.
Second Office Action for Chinese Application No. 201610004860.1, dated Nov. 17, 2017, 7 Pages.

* cited by examiner

METHOD AND DEVICE FOR DRIVING GOA CIRCUIT, TIME CONTROLLER, AND DISPLAY DEVICE

CROSS-REFERENCE TO RELATED APPLICATIONS

This application claims priority to Chinese Patent Application No. 201610004860.1, filed Jan. 4, 2016, which is hereby incorporated by reference in its entirety.

TECHNICAL FIELD

The present disclosure relates to the field of liquid crystal display technology, in particular to a method and a device for driving a gate driver on array (GOA) circuit, a time controller, and a display device.

BACKGROUND

In a thin film transistor-liquid crystal display (TFT-LCD), for a GOA circuit where six clock (CLK) signals are used, two different rows of gate electrodes may be turned on in different degrees due to an impedance difference between CLK signal lines. As a result, such a defect as horizontal striped patterns may occur for a display panel with six rows of pixels as an occurrence period.

SUMMARY

An object of the present disclosure is to provide a method and a device for driving a GOA circuit, a time controller and a display device, so as to compensate for brightness at rows where striped patterns are located, thereby to prevent the occurrence of the striped patterns capable of being viewed by human eyes.

In one aspect, the present disclosure provides in some embodiments a method for driving a GOA circuit, including steps of: determining a bright-dark period for striped patterns on a display panel; and compensating for data signals at rows where the striped patterns are located periodically in accordance with the bright-dark period.

According to the method in the embodiments of the present disclosure, the bright-dark period for the striped patterns on the display panel is determined at first, and then the compensation may be performed for the data signals at the rows where the striped patterns are located periodically in accordance with the bright-dark period. As a result, it is able to compensate for the brightness at the rows where the striped patterns are located, thereby to prevent the occurrence of the striped patterns capable of being viewed by human eyes.

Optionally, the step of compensating for the data signals at the rows where the striped patterns are located periodically in accordance with the bright-dark period includes outputting, by a time controller TCON, a first data signal to a dark row of the rows where the striped patterns are located in accordance with a predetermined period, the first data signal being capable of providing a grayscale value greater than a predetermined grayscale value by a predetermined number of grayscales. For example, the first data signal is capable of providing a grayscale value greater than the predetermined grayscale value by one or two grayscales, so as to increase the brightness at the dark row.

Optionally, the step of compensating for the data signals at the rows where the striped patterns are located periodically in accordance with the bright-dark period includes outputting, by the time controller TCON, a second data signal to a bright row of the rows where the striped patterns are located in accordance with a predetermined period, the second data signal being capable of providing a grayscale value smaller than the predetermined grayscale value by a predetermined number of grayscales. For example, the second data signal is capable of providing a grayscale value greater than the predetermined grayscale value by one or two grayscales, so as to reduce the brightness at the bright row.

According to the method in the embodiments of the present disclosure, it is able to reduce the brightness difference between the rows where the striped patterns are located in a better manner, thereby to prevent the occurrence of the striped patterns capable of being viewed by human eyes.

Optionally, the dark-bright period includes six rows of pixels.

Optionally, the step of compensating for the data signals at the rows where the striped patterns are located periodically in accordance with the bright-dark period includes inserting a frame for compensating for the data signals every N frames, so as to compensate for the data signals at the rows where the striped patterns are located periodically, where N is a positive integer.

Optionally, N is 1, 2 or 3.

Optionally, the step of determining the bright-dark period for the striped patterns on the display panel includes determining in advance, by testing, the bright-dark period for the striped patterns on the display panel, and storing the bright-dark period in the time controller.

In another aspect, the present disclosure provides in some embodiments a device for driving a GOA circuit, including: a first unit configured to determine a bright-dark period for striped patterns on a display panel; and a second unit configured to compensate for data signals at rows where the striped patterns are located periodically in accordance with the bright-dark period.

According to the device in the embodiments of the present disclosure, the first unit determines the bright-dark period for the striped patterns on the display panel at first, and then the second unit compensate for the data signals at the rows where the striped patterns are located periodically in accordance with the bright-dark period. As a result, it is able to compensate for the brightness at the rows where the striped patterns are located, thereby to prevent the occurrence of the striped patterns capable of being viewed by human eyes.

Optionally, the second unit is further configured to output a first data signal to a dark row of the rows where the striped patterns are located in accordance with a predetermined period, the first data signal being capable of providing a grayscale value greater than a predetermined grayscale value by a predetermined number of grayscales. For example, the first data signal is capable of providing a grayscale value greater than the predetermined grayscale value by one or two grayscales, so as to increase the brightness at the dark row.

Optionally, the second unit is further configured to output a second data signal to a bright row of the rows where the striped patterns are located in accordance with a predetermined period, the second data signal being capable of providing a grayscale value smaller than the predetermined grayscale value by a predetermined number of grayscales. For example, the second data signal is capable of providing a grayscale value greater than the predetermined grayscale value by one or two grayscales, so as to reduce the brightness at the bright row.

According to the device in the embodiments of the present disclosure, it is able to reduce the brightness difference between the rows where the striped patterns are located in a better manner, thereby to prevent the occurrence of the striped patterns capable of being viewed by human eyes.

Optionally, the dark-bright period includes six rows of pixels.

Optionally, the second unit is further configured to insert a frame for compensating for the data signals every N frames, so as to compensate for the data signals at the rows where the striped patterns are located periodically, where N is a positive integer.

Optionally, N is 1, 2 or 3.

Optionally, the first unit is further configured to determine in advance, by testing, the bright-dark period for the striped patterns on the display panel, and storing the bright-dark period in the time controller.

In yet another aspect, the present disclosure provides in some embodiments a time controller, including the above-mentioned device for driving a GOA circuit.

According to the time controller in the embodiments of the present disclosure, it is able to compensate for the brightness at the rows where the striped patterns are located by adjusting the data signals outputted to the rows of the display panel periodically ad adjusting the data signals outputted to an identical row within various frames, thereby to prevent the occurrence of the horizontal striped patterns capable of being viewed by human eyes.

In still yet another aspect, the present disclosure provides in some embodiments a display panel including a GOA circuit and the above-mentioned time controller for driving the GOA circuit.

According to the display device in the embodiments of the present disclosure, it is able to compensate for, by the time controller, the brightness at the rows where the striped patterns are located by adjusting the data signals outputted to the rows of the display panel periodically and adjusting the data signals outputted to an identical row within various frames, thereby to prevent the occurrence of the horizontal striped patterns capable of being viewed by human eyes.

DETAILED DESCRIPTION

As required, detailed embodiments are disclosed herein. However, it is to be understood that the disclosed embodiments are merely exemplary and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

The present disclosure provides in some embodiments a method and a device for driving a GOA circuit, a time controller and a display device, so as to compensate for brightness at rows where striped patterns are located, thereby to prevent the occurrence of the striped patterns capable of being viewed by human eyes.

According to the embodiments of the present disclosure, it is able to compensate for, by the time controller (TCON), brightness at rows in the GOA by adjusting data signals outputted to the rows of a display panel periodically and adjusting data signals outputted to an identical row within various frames, thereby to prevent the occurrence of the horizontal striped patterns capable of being viewed by human eyes.

The present disclosure will be described hereinafter in conjunction with the drawings and embodiments.

Figure 1:
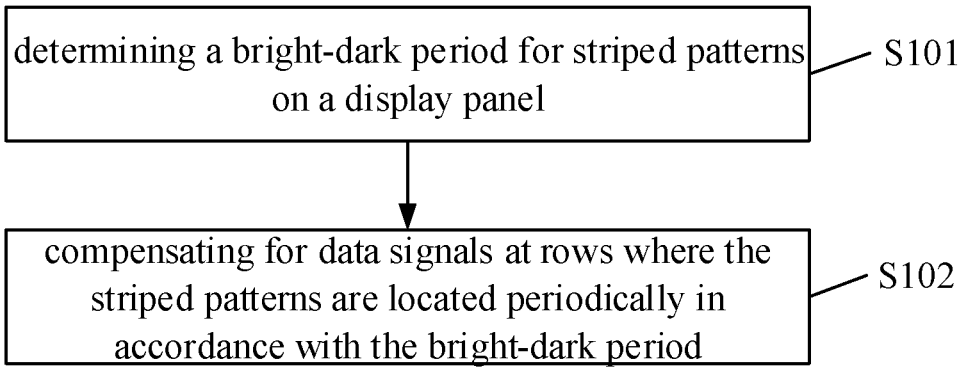
FIG. 1 is a flow chart of a method for driving a GOA circuit according to one embodiment of the present disclosure.

As shown in FIG. 1, the present disclosure provides in some embodiments a method for driving a GOA circuit, including: Step S101 of determining a bright-dark period for striped patterns on a display panel; and Step S102 of compensating for data signals at rows where the striped patterns are located periodically in accordance with the bright-dark period.

According to the method in the embodiments of the present disclosure, the bright-dark period for the striped patterns on the display panel is determined at first, and then the compensation may be performed for the data signals at the rows where the striped patterns are located periodically in accordance with the bright-dark period. As a result, it is able to compensate for the brightness at the rows where the striped patterns are located, thereby to prevent the occurrence of the striped patterns capable of being viewed by human eyes.

Optionally, the step of compensating for the data signals at the rows where the striped patterns are located periodically in accordance with the bright-dark period may include outputting, by a time controller TCON, a first data signal to a dark row of the rows where the striped patterns are located in accordance with a predetermined period, the first data signal being capable of providing a grayscale value greater than a predetermined grayscale value by a predetermined number of grayscales. For example, the first data signal is capable of providing a grayscale value greater than the predetermined grayscale value by one or two grayscales, so as to increase the brightness at the dark row. Optionally, the step of compensating for the data signals at the rows where the striped patterns are located periodically in accordance with the bright-dark period may include outputting, by the time controller TCON, a second data signal to a bright row of the rows where the striped patterns are located in accordance with a predetermined period, the second data signal being capable of providing a grayscale value smaller than the predetermined grayscale value by a predetermined number of grayscales. For example, the second data signal is capable of providing a grayscale value greater than the predetermined grayscale value by one or two grayscales, so as to reduce the brightness at the bright row. The predetermined grayscale value may be a grayscale value desired to be displayed at a corresponding row.

Taking a grayscale value of 127 to be normally displayed as an example, the dark row of the rows where the striped patterns are located may be a row having a grayscale value of 126, and the bright row of the rows where the striped patterns are located may be a row having a grayscale value of 128. The dark and bright rows may be determined in accordance with the grayscale values.

For example, the signals applied to every six rows of pixels may be preset in the time controller TCON. In an optional embodiment of the present disclosure, depending on the actual bright and dark striped patterns on the display panel, a first row of every six rows may be provided a grayscale value of 128, a second row may be provided with a grayscale value of 125, a third row may be provided with a grayscale value of 127, a fourth row may be provided with a grayscale value of 126, a fifth row may be provided with a grayscale value of 127, and a sixth row may be provided with a grayscale value of 125.

According to the method in the embodiments of the present disclosure, it is able to reduce the brightness difference between the rows where the striped patterns are located in a better manner, thereby to prevent the occurrence of the striped patterns capable of being viewed by human eyes.

Figure 2:
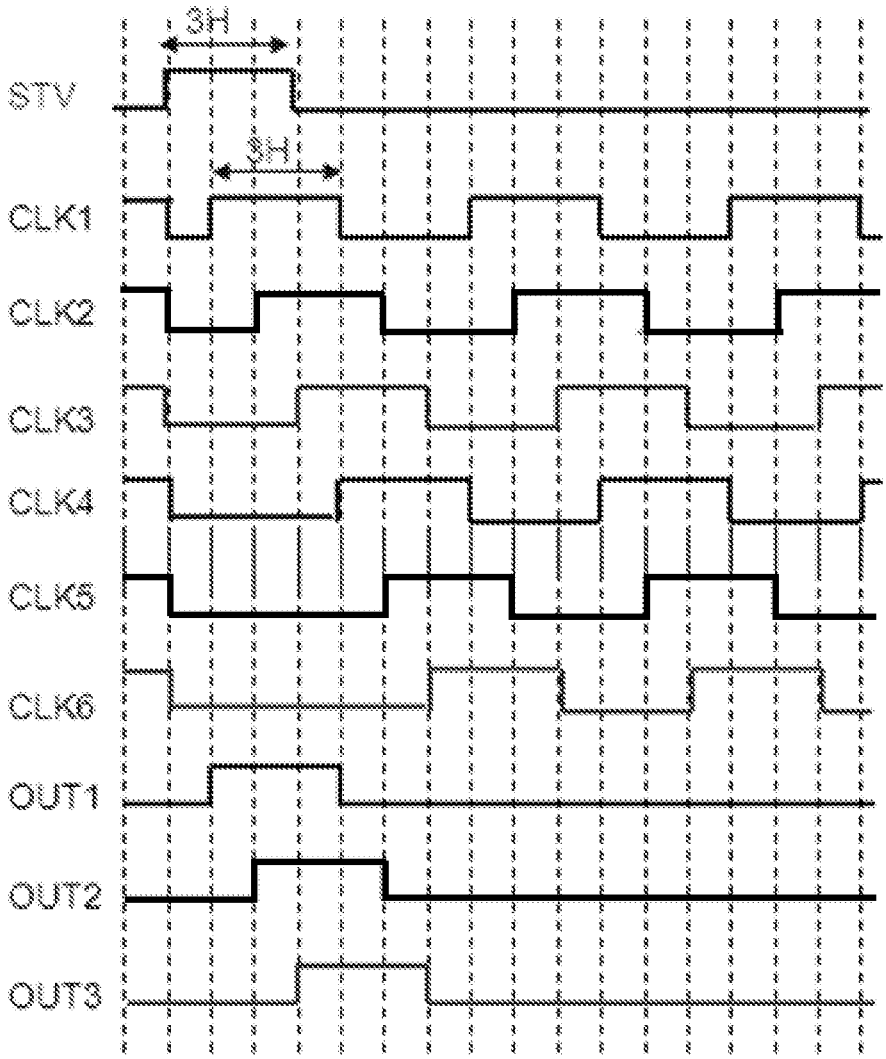
FIG. 2 is a sequence diagram of clock signals for six rows of pixels according to one embodiment of the present disclosure.

Optionally, the dark-bright period includes six rows of pixels, i.e., the bright and dark striped patterns are identical for every six rows of pixels. As shown in FIG. 2, clock signals for the six rows of pixels are CLK1 to CLK6 respectively, the scanning periods of three rows is 3H, a start signal for gate scanning is represented by STV (Start Vertical), and OUT1, OUT2, OUT3 are turned-on signals for corresponding three rows, i.e., the first row, the second row and the third row.

Optionally, a frame for compensating for the data signals may be inserted every N frames, so as to periodically compensate for the data signals at the rows where the striped patterns are located. N is a positive integer, e.g., 1, 2 or 3.

It should be appreciated that, in the case that the striped patterns on the display panel are very wide, such a defect may also be called as mura. Hence, according to the embodiments of the present disclosure, it is able to prevent the occurrence of mura in a similar manner.

In the embodiments of the present disclosure, the bright-dark period of the striped patterns on the display panel may be tested manually in advance and then stored in the time controller TCON. Then, the time controller may adjust its output in accordance with the bright-dark period, so as to periodically compensate for the data signals at the rows. Within the bright-dark period, the data signal applied to the dark row is capable of providing a grayscale value greater than the predetermined grayscale value by one grayscale. For example, in the case that the grayscale value to be displayed is L127, a data signal capable of providing a grayscale value of L128 or L129 may be applied to the dark row during the scanning. In addition, the data signal applied to the bright row is capable of providing a grayscale value smaller than the predetermined grayscale value by one grayscale. To be specific, a frame for compensation may be inserted every N frames, and N is a positive integer. Usually, N is smaller than 4, so as to achieve a better compensation effect.

Figure 3:
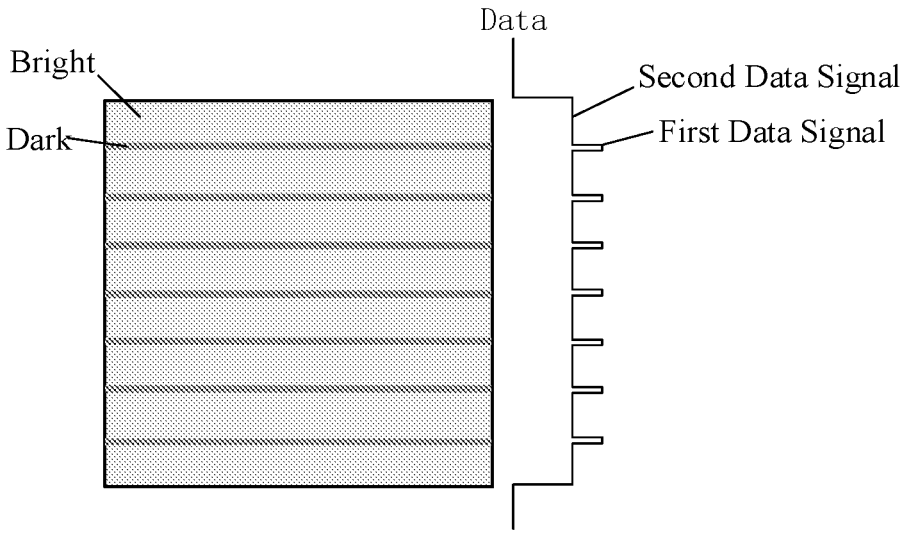
FIG. 3 is a schematic view showing the voltage variation of data signals for compensating for brightness of pixels at different rows according to one embodiment of the present disclosure.

As shown in FIG. 3, in the embodiments of the present disclosure, for a dark region, a voltage across a corresponding data line (i.e., the data signal) may be increased appropriately, so as to enable the brightness at the dark region to be identical to that at the other regions. For a bright region, a voltage across a corresponding data line (i.e., the data signal) may be decreased appropriately, so as to enable the brightness at the dark region to be identical to that at the other regions.

It should be appreciated that, in the embodiments of the present disclosure, merely the data signal applied to the dark or bright region may be adjusted. Of course, the data signals applied to both the dark and bright regions may be adjusted simultaneously, so as to provide the display panel with even brightness. In the case that merely the data signal applied to the dark or bright region is adjusted, it is still able to improve the brightness uniformity in a simpler manner.

Figure 4:
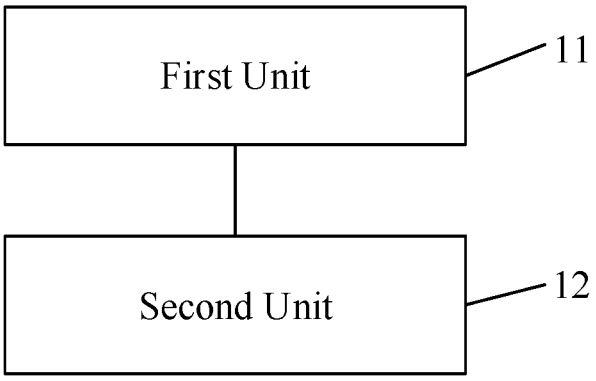
FIG. 4 is a schematic view showing a device for driving a GOA circuit according to one embodiment of the present disclosure.

As shown in FIG. 4, the present disclosure provides in some embodiments a device for driving a GOA circuit, including: a first unit 11 configured to determine a bright-dark period for striped patterns on a display panel; and a second unit 12 configured to periodically compensate for data signals at rows where the striped patterns are located in accordance with the bright-dark period.

Here, the first unit 11 may be a period determination circuit, and the second unit 12 may be a data signal compensation circuit.

According to the device in the embodiments of the present disclosure, the first unit determines the bright-dark period for the striped patterns on the display panel at first, and then the second unit compensate for the data signals at the rows where the striped patterns are located periodically in accordance with the bright-dark period. As a result, it is able to compensate for the brightness at the rows where the striped patterns are located, thereby to prevent the occurrence of the striped patterns capable of being viewed by human eyes.

Optionally, the second unit is further configured to output a first data signal to a dark row of the rows where the striped patterns are located in accordance with a predetermined period, the first data signal being capable of providing a grayscale value greater than a predetermined grayscale value by a predetermined number of grayscales. For example, the first data signal is capable of providing a grayscale value greater than the predetermined grayscale value by one or two grayscales, so as to increase the brightness at the dark row.

Optionally, the second unit is further configured to output a second data signal to a bright row of the rows where the striped patterns are located in accordance with a predetermined period, the second data signal being capable of providing a grayscale value smaller than the predetermined grayscale value by a predetermined number of grayscales. For example, the second data signal is capable of providing a grayscale value greater than the predetermined grayscale value by one or two grayscales, so as to reduce the brightness at the bright row.

According to the device in the embodiments of the present disclosure, it is able to reduce the brightness difference between the rows where the striped patterns are located in a better manner, thereby to prevent the occurrence of the striped patterns capable of being viewed by human eyes.

Optionally, the dark-bright period includes six rows of pixels.

Optionally, the second unit may be further configured to insert a frame for compensating for the data signals every N frames, so as to periodically compensating for the data signals at the rows where the striped patterns are located, where N is a positive integer.

The present disclosure further provides in some embodiments a time controller, including the above-mentioned device for driving a GOA circuit.

According to the time controller in the embodiments of the present disclosure, it is able to compensate for the brightness at the rows where the striped patterns are located by adjusting the data signals outputted to the rows of the display panel periodically and adjusting the data signals outputted to an identical row within various frames, thereby to prevent the occurrence of the horizontal striped patterns capable of being viewed by human eyes.

Figure 5:
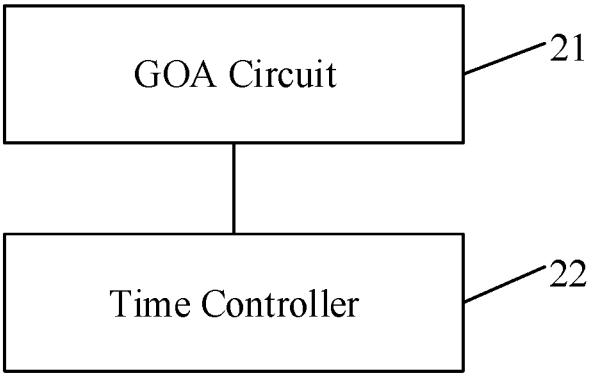
FIG. 5 is a schematic view showing a display device according to one embodiment of the present disclosure.

As shown in FIG. 5, the present disclosure further provides in some embodiments a display device, including a GOA circuit 21 and the above-mentioned time controller 22 for driving the GOA circuit.

According to the display device in the embodiments of the present disclosure, it is able to compensate for, by the time controller, the brightness at the rows where the striped patterns are located by adjusting the data signals outputted to the rows of the display panel periodically and adjusting the data signals outputted to an identical row within various frames, thereby to prevent the occurrence of the horizontal striped patterns capable of being viewed by human eyes.

It should be appreciated that, the units mentioned in the embodiments of the present disclosure may be implemented by entities such as processors, or various circuits.

According to the embodiments of the present disclosure, as compared with the related art, it is able to reduce the brightness difference by compensating for the data signals at the rows where the striped patterns are located, thereby to prevent the occurrence of the striped patterns on the display panel including the GOA circuit.

The above are merely the preferred embodiments of the present disclosure. Obviously, a person skilled in the art may make further modifications and improvements without departing from the spirit of the present disclosure, and these modifications and improvements shall also fall within the scope of the present disclosure.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method for driving a Gate driver On Array (GOA) circuit, comprising steps of:

determining a bright-dark period for horizontal striped patterns of rows on a display panel, wherein the horizontal striped patterns occur due to an impedance difference between clock (CLK) signal lines; and compensating for data signals at rows where the horizontal striped patterns are located periodically in accordance with the bright-dark period;

wherein the determining the bright-dark period for the horizontal striped patterns on the display panel comprises: testing the bright-dark period for the horizontal striped patterns on the display panel, and storing the bright-dark period in a time controller.

2. The method according to claim 1, wherein the step of compensating for the data signals at the rows where the horizontal striped patterns are located periodically in accordance with the bright-dark period comprises:

outputting, by a time controller, a first data signal to a dark row of the rows where the horizontal striped patterns are located in accordance with the bright-dark period, the first data signal being capable of providing a grayscale value greater than a grayscale value of the dark row by a predetermined number of grayscales.

3. The method according to claim 1, wherein the step of compensating for the data signals at the rows where the horizontal striped patterns are located periodically in accordance with the bright-dark period comprises:

outputting, by a time controller, a second data signal to a bright row of the rows where the horizontal striped patterns are located in accordance with the bright-dark period, the second data signal being capable of providing a grayscale value smaller than a grayscale value of the bright row by a predetermined number of grayscales.

4. The method according to claim 1, wherein the dark-bright period comprises six rows of pixels.

5. The method according to claim 1, wherein the step of compensating for the data signals at the rows where the horizontal striped patterns are located periodically in accordance with the bright-dark period comprises:

inserting a frame for compensating for the data signals every N frames, so as to compensate for the data signals at the rows where the horizontal striped patterns are located periodically, where N is a positive integer.

6. The method according to claim 5, wherein N is 1, 2 or 3.

7. A device for driving a Gate driver On Array (GOA) circuit, comprising:

a first unit configured to determine a bright-dark period for horizontal striped patterns of rows on a display panel, wherein the horizontal striped patterns occur due to an impedance difference between clock (CLK) signal lines; and a second unit configured to compensate for data signals at rows where the horizontal striped patterns are located periodically in accordance with the bright-dark period period;

wherein the first unit is configured to test the bright-dark period for the horizontal striped patterns on the display panel and store the bright-dark period in a time controller.

8. The device according to claim 7, wherein the second unit is further configured to output a first data signal to a dark row of the rows where the horizontal striped patterns are located in accordance with the bright-dark period, the first data signal being capable of providing a grayscale value greater than a grayscale value of the dark row by a predetermined number of grayscales.

9. The device according to claim 7, wherein the second unit is further configured to output a second data signal to a bright row of the rows where the horizontal striped patterns are located in accordance with the bright-dark period, the second data signal being capable of providing a grayscale value smaller than a grayscale value of the bright row by a predetermined number of grayscales.

10. The device according to claim 7, wherein the dark-bright period comprises six rows of pixels.

11. The device according to claim 7, wherein the second unit is further configured to insert a frame for compensating for the data signals every N frames, so as to compensate for the data signals at the rows where the horizontal striped patterns are located periodically, where N is a positive integer.

12. The device according to claim 11, wherein N is 1, 2 or 3.

13. A time controller, comprising the device according to claim 7.

14. The time controller according to claim 13, wherein the second unit is further configured to output a first data signal to a dark row of the rows where the horizontal striped patterns are located in accordance with the bright-dark period, the first data signal being capable of providing a grayscale value greater than a grayscale value of the dark row by a predetermined number of grayscales.

15. The time controller according to claim 13, wherein the second unit is further configured to output a second data signal to a bright row of the rows where the horizontal striped patterns are located in accordance with a predetermined period the bright-dark period, the second data signal being capable of providing a grayscale value smaller than a grayscale value of the bright row by a predetermined number of grayscales.

16. The time controller according to claim 13, wherein the dark-bright period comprises six rows of pixels.

17. The time controller according to claim 13, wherein the second unit is further configured to insert a frame for compensating for the data signals every N frames, so as to compensate for the data signals at the rows where the horizontal striped patterns are located periodically, where N is a positive integer.

18. A display device, comprising a Gate driver On Array (GOA) circuit, and the time controller according to claim 13 for driving the GOA circuit.

* * * * *